US011892217B2

(12) United States Patent
Swofford et al.

(10) Patent No.: US 11,892,217 B2
(45) **Date of Patent: *Feb. 6, 2024**

(54) REFRIGERATION SYSTEM WITH CONDENSER TEMPERATURE DIFFERENTIAL SETPOINT CONTROL

(71) Applicant: Hill Phoenix, Inc., Conyers, GA (US)

(72) Inventors: Timothy D. Swofford, Midlothian, VA (US); Neil J. Rathje, South Chesterfield, VA (US); Jules G. Choueifati, Richmond, VA (US)

(73) Assignee: Hill Phoenix, Inc., Conyers, GA (US)

( * ) Notice: Subject to any disclaimer, the term of this patent is extended or adjusted under 35 U.S.C. 154(b) by 57 days.

This patent is subject to a terminal disclaimer.

(21) Appl. No.: 17/479,379

(22) Filed: Sep. 20, 2021

(65) Prior Publication Data

US 2022/0003475 A1 Jan. 6, 2022

Related U.S. Application Data

(63) Continuation of application No. 15/387,300, filed on Dec. 21, 2016, now Pat. No. 11,125,483.

(Continued)

(51) Int. Cl.
*F25B 49/02* (2006.01)
*F25D 17/02* (2006.01)

(Continued)

(52) U.S. Cl.
CPC ..... *F25B 49/027* (2013.01); *F25B 9/008* (2013.01); *F25B 39/00* (2013.01); *F25B 49/02* (2013.01);

(Continued)

(58) Field of Classification Search
CPC ..... F25B 49/027; F25B 49/02; F25B 9/008; F25B 39/00; F25B 39/04; F25B 17/02;

(Continued)

(56) References Cited

U.S. PATENT DOCUMENTS 4,270,363 A 6/1981 Maring et al.
4,589,263 A 5/1986 Dicarlo et al.

(Continued)

FOREIGN PATENT DOCUMENTS

DE 102014222108 5/2016
EP 1789732 5/2007

(Continued)

OTHER PUBLICATIONS

Co2oltec, A world first in technology: Refrigeration with CO2, special print from KK Die Kalte & Klimatechnik, Edition Feb. 2005, 15 pages.

(Continued)

*Primary Examiner* — Tavia Sullens
(74) *Attorney, Agent, or Firm* — Fish & Richardson P.C.

(57) ABSTRACT

A refrigeration system for a temperature-controlled storage device includes a refrigeration circuit that circulates a refrigerant, a separate cooling circuit that circulates a coolant, and a controller. The refrigeration circuit includes a compressor, a condenser, an expansion device, and an evaporator. The cooling circuit includes a pump, a control valve, and a heat removing device in fluid communication with the condenser via the coolant. The controller is operatively coupled to the control valve and configured to identify a coolant temperature differential setpoint, monitor a temperature of the coolant provided to the condenser by the cooling circuit, calculate a coolant temperature differential based on the temperature of the coolant provided to the condenser, and operate the control valve to modulate a flow of the coolant through the condenser to drive the coolant temperature differential to the coolant temperature differential setpoint.

17 Claims, 6 Drawing Sheets

Related U.S. Application Data

(60) Provisional application No. 62/352,789, filed on Jun. 21, 2016.

(51) Int. Cl.
*F25B 9/00* (2006.01)
*F25B 39/00* (2006.01)
*F25B 39/04* (2006.01)

(52) U.S. Cl.
CPC ..... *F25D 17/02* (2013.01); *F25B 39/04* (2013.01); *F25B 2339/047* (2013.01); *F25B 2400/22* (2013.01); *F25B 2700/195* (2013.01); *F25B 2700/21161* (2013.01)

(58) Field of Classification Search
CPC ..... F25B 2339/047; F25B 2400/22; F25B 2700/195; F25B 2700/21; F25B 2700/21162; F25B 2700/21163; F25B 2700/2116
See application file for complete search history.

(56) References Cited

U.S. PATENT DOCUMENTS

| | | | |
|---|---|---|---|
| 5,425,246 | A | 6/1995 | Bessler |
| 5,539,382 | A | 7/1996 | Duff et al. |
| 6,385,980 | B1 | 5/2002 | Sienel |
| 6,415,611 | B1 | 7/2002 | Acharya et al. |
| 6,418,735 | B1 | 7/2002 | Sienel |
| 7,065,979 | B2 | 6/2006 | Arshansky et al. |
| 7,406,837 | B2 | 8/2008 | Nemoto et al. |
| 7,913,506 | B2 | 3/2011 | Bittner et al. |
| 8,011,192 | B2 | 9/2011 | Gupte |
| 8,156,754 | B2 | 4/2012 | Hong et al. |
| 8,511,103 | B2 | 8/2013 | Welch |
| 8,631,666 | B2 | 1/2014 | Hinde et al. |
| 8,756,947 | B2 | 6/2014 | Chen et al. |
| 8,966,934 | B2 | 3/2015 | Christensen |
| 9,121,631 | B2 | 9/2015 | Cho et al. |
| 9,151,521 | B2 | 10/2015 | Bittner |
| 9,335,079 | B2 | 5/2016 | Huff et al. |
| 9,353,980 | B2 | 5/2016 | Ignatiev |
| 9,395,112 | B2 | 7/2016 | Prins |
| 9,470,435 | B2 | 10/2016 | Hinde et al. |
| 9,541,311 | B2 | 1/2017 | Hinde et al. |
| 9,625,183 | B2 | 4/2017 | Wallace et al. |
| 9,657,977 | B2 | 5/2017 | Hinde et al. |
| 9,664,424 | B2 | 5/2017 | Hinde et al. |
| 9,689,590 | B2 | 6/2017 | Christensen |
| 11,125,483 | B2 * | 9/2021 | Swofford ..... F25B 49/027 |
| 2003/0182961 | A1 | 10/2003 | Nishida et al. |
| 2005/0011221 | A1 | 1/2005 | Hirota |
| 2005/0178150 | A1 | 8/2005 | Oshitani et al. |
| 2005/0217278 | A1 | 10/2005 | Mongia et al. |
| 2005/0268625 | A1 | 12/2005 | Sienel et al. |
| 2007/0199337 | A1 | 8/2007 | Otake |
| 2008/0006044 | A1 | 1/2008 | Tan |
| 2008/0098754 | A1 | 5/2008 | Sommer et al. |
| 2008/0196420 | A1 | 8/2008 | Gernemann |
| 2008/0264077 | A1 | 10/2008 | Heinbokel |
| 2010/0000245 | A1 | 1/2010 | Kasahara et al. |
| 2010/0199707 | A1 | 8/2010 | Pearson |
| 2010/0263393 | A1 | 10/2010 | Chen et al. |
| 2011/0036110 | A1 | 2/2011 | Fujimoto et al. |
| 2011/0041527 | A1 | 2/2011 | Jakobsen et al. |
| 2011/0162397 | A1 | 7/2011 | Huff et al. |
| 2011/0314843 | A1 | 12/2011 | Heinbokel et al. |
| 2012/0000237 | A1 | 1/2012 | Yamada et al. |
| 2012/0011866 | A1 | 1/2012 | Scarcella et al. |
| 2012/0055182 | A1 | 3/2012 | Dube |
| 2012/0073319 | A1 | 3/2012 | Dube |
| 2012/0192579 | A1 | 8/2012 | Huff et al. |
| 2012/0247148 | A1 | 10/2012 | Dube |
| 2013/0125569 | A1 | 5/2013 | Verma et al. |
| 2013/0233009 | A1 | 9/2013 | Dube |
| 2013/0298593 | A1 | 11/2013 | Christensen |
| 2014/0007603 | A1 | 1/2014 | Dube |
| 2014/0116075 | A1 | 5/2014 | Prins |
| 2014/0157811 | A1 | 6/2014 | Shimazu et al. |
| 2014/0208785 | A1 | 7/2014 | Wallace et al. |
| 2014/0291411 | A1 | 10/2014 | Tamaki et al. |
| 2014/0326018 | A1 | 11/2014 | Ignatiev |
| 2014/0352343 | A1 | 12/2014 | Hinde et al. |
| 2015/0052927 | A1 | 2/2015 | Yang et al. |
| 2015/0128628 | A1 | 5/2015 | Kawagoe et al. |
| 2015/0345835 | A1 | 12/2015 | Martin et al. |
| 2015/0354882 | A1 | 12/2015 | Dube |
| 2016/0102901 | A1 | 4/2016 | Christensen et al. |
| 2016/0245575 | A1 | 8/2016 | Dube |
| 2017/0363337 | A1 | 12/2017 | Swofford et al. |
| 2018/0216851 | A1 | 8/2018 | Christensen et al. |
| 2019/0368786 | A1 | 12/2019 | Newel et al. |
| 2020/0033039 | A1 | 1/2020 | Krishnamoorthy et al. |

FOREIGN PATENT DOCUMENTS

| | | |
|---|---|---|
| EP | 1848933 | 12/2010 |
| EP | 2407734 | 1/2012 |
| EP | 2078178 | 5/2016 |
| EP | 2329206 | 10/2016 |
| EP | 2212631 | 12/2016 |
| GB | 2460726 | 12/2009 |
| JP | 2004/257694 | 9/2004 |
| JP | 2005/024210 | 1/2005 |
| JP | 2011/503504 | 1/2011 |
| WO | WO 2006/087011 | 8/2006 |
| WO | WO 2006/091190 | 8/2006 |
| WO | WO 2009/086493 | 7/2009 |
| WO | WO 2010/045743 | 4/2010 |
| WO | WO 2011/066214 | 6/2011 |
| WO | WO 2011/071959 | 6/2011 |
| WO | WO 2013/169591 | 11/2013 |
| WO | WO 2014/068967 | 5/2014 |
| WO | WO 2014/179699 | 11/2014 |

OTHER PUBLICATIONS

EP Extended European Search Report in European U.S. Appl. No. 17/151,864, dated May 31, 2017, 7 pages.

Heat recovery from CO2 based refrigeration systems, Advansor Energisystemer, dated Mar. 26, 2008, 5 pages.

Heos user manual for high efficiency showcase controller, Carel Industries, dated Sep. 24, 2015, 56 pages.

Office Action regarding EP Appl. No. 17151864.0, dated Dec. 7, 2020, 6 pages.

Office Action in Canadian Appln. No. 2,954,682, dated May 4, 2023, 5 pages.

* cited by examiner

REFRIGERATION SYSTEM WITH CONDENSER TEMPERATURE DIFFERENTIAL SETPOINT CONTROL

CROSS-REFERENCE TO RELATED PATENT APPLICATION

This application is a continuation application of and claims priority under 35 U.S.C. § 120 to U.S. application Ser. No. 15/387,300, filed on Dec. 21, 2016, which will issue as U.S. Pat. No. 11,125,483, which in turn claims the benefit of and priority to U.S. Provisional Patent Application No. 62/352,789 filed Jun. 21, 2016, the entire contents of each of which are incorporated herein by reference.

BACKGROUND

The present disclosure relates generally to the field of refrigeration systems. Refrigeration systems are often used to provide cooling to temperature controlled display devices (e.g. cases, merchandisers, etc.) in supermarkets and other similar facilities. Vapor compression refrigeration systems are a type of refrigeration system which provide such cooling by circulating a fluid refrigerant (e.g., a liquid and/or vapor) through a thermodynamic vapor compression cycle. In a vapor compression cycle, the refrigerant is typically (1) compressed to a high temperature high pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant. Often, secondary liquid cooling systems provide the cooling necessary to operate the condenser and complete step (2) of this process.

Existing solutions to control the temperatures of display devices often rely upon a temperature setpoint of the refrigerant and operate the components of the refrigeration system accordingly. However, these solutions are inefficient because they fail to account for the characteristics of the liquid coolant used in operating the condenser. For example, in a scenario in which the liquid coolant is a higher temperature than the refrigerant condensing setpoint temperature, the controller may operate the liquid cooling system at its maximum capacity in an attempt to achieve a setpoint that is physically impossible to reach due to the temperature of the liquid coolant.

SUMMARY

One implementation of the present disclosure is a refrigeration system for a temperature-controlled storage device. The refrigeration system includes a refrigeration circuit that circulates a refrigerant. The refrigeration circuit includes a compressor, a condenser, an expansion device, and an evaporator. The refrigeration system also includes a cooling circuit separate from the refrigeration circuit and configured to circulate a coolant through the condenser to provide cooling for the refrigerant. The cooling circuit includes a pump, a control valve, and a heat removing device in fluid communication with the condenser via the coolant. The refrigeration further includes a controller operatively coupled to the control valve. The controller is configured to identify a coolant temperature differential setpoint, monitor a temperature of the coolant provided to the condenser by the cooling circuit, calculate a coolant temperature differential based on the temperature of the coolant provided to the condenser, and provide a signal to the control valve to modulate a flow of the coolant through the condenser to drive the coolant temperature differential to the coolant temperature differential setpoint.

In some embodiments, the controller is configured to determine a condensing temperature of the refrigerant in the condenser. In some embodiments, the coolant temperature differential is a difference between the condensing temperature of the refrigerant in the condenser and the temperature of the coolant provided to the condenser.

In some embodiments, the controller determines the condensing temperature of the refrigerant in the condenser by monitoring a condensing pressure of the refrigerant in the condenser and calculating the condensing temperature based on the condensing pressure.

In some embodiments, the controller is configured to monitor a temperature of the coolant exiting the condenser. In some embodiments, the coolant temperature differential is a difference between the temperature of the coolant exiting the condenser and the temperature of the coolant provided to the condenser.

In some embodiments, the controller is configured to open the control valve to increase the flow of the coolant through the condenser when the coolant temperature differential is higher than the coolant temperature differential setpoint. In some embodiments, the controller is configured to close the control valve to decrease the flow of the coolant through the condenser when the coolant temperature differential is lower than the coolant temperature differential setpoint.

In some embodiments, the refrigerant is carbon dioxide ($CO_2$). In some embodiments, the coolant is water or a mixture of water and glycol.

In some embodiments, the controller identifies a temperature differential constraint and monitors a coolant outlet temperature at an outlet of the condenser and a coolant inlet temperature at an inlet of the condenser. The controller calculates an actual temperature differential between the coolant outlet temperature and the coolant inlet temperature and operates the control valve to decrease the flow of the coolant through the condenser in response to the actual temperature differential being less than the temperature differential constraint.

In some embodiments, the controller is configured to identify a temperature differential constraint and monitor a condenser temperature differential between a temperature of the coolant at an outlet of the condenser and a temperature of the coolant at an inlet of the condenser. The controller may operate the control valve to decrease the flow of the coolant through the condenser in response to the condenser temperature differential being less than the temperature differential constraint.

In some embodiments, the controller identifies a maximum temperature limit for the condensing temperature of the refrigerant and ceases operating the control valve in response to the condensing temperature of the refrigerant exceeding the maximum temperature limit.

In some embodiments, the controller identifies a minimum temperature limit for the condensing temperature of the refrigerant and ceases operating the control valve in response to the condensing temperature of the refrigerant dropping below the minimum temperature limit.

In some embodiments, the controller operates at least one of the compressor and the expansion device to modulate a flow rate of the refrigerant to maintain a desired temperature of the temperature-controlled storage device.

In some embodiments, the controller identifies a preopening time period for the control valve during an initialization period of the refrigeration system and identifies a preopening position for the control valve during the initialization period. The controller further operates the control valve to achieve the preopening position for a duration of the preopening time period.

Another implementation of the present disclosure is a cooling circuit for a temperature-controlled storage device. The cooling circuit includes a pump that circulates a coolant through the cooling circuit, a heat exchanger that transfers heat from a refrigerant flowing through the heat exchanger to the coolant flowing through the heat exchanger, and a fluid control valve that modulates a flow rate of the coolant through the heat exchanger. The cooling circuit further includes a controller. The controller identifies a setpoint value for a temperature differential between a saturation temperature of the refrigerant as it condenses in the heat exchanger and a temperature of the coolant as it enters the heat exchanger. The controller further operates the fluid control valve to maintain the saturation temperature of the refrigerant as it condenses in the heat exchanger equal to a sum of the setpoint value and the temperature of the coolant as it enters the heat exchanger.

In some embodiments, the cooling circuit includes a second heat exchanger. The second heat exchanger transfers heat from the coolant to a second refrigerant flowing through the second heat exchanger.

In some embodiments, the coolant is water or a mixture of water and glycol. In some embodiments, the refrigerant is carbon dioxide ($CO_2$).

Another implementation of the present disclosure is a method for controlling a refrigeration system that includes a refrigeration circuit, a cooling circuit, and a heat exchanger coupled to the refrigeration circuit and the cooling circuit. The method includes identifying a temperature differential setpoint, and monitoring a temperature of a coolant provided to the heat exchanger by the cooling circuit. The method further includes determining a condensing temperature of a refrigerant provided to the heat exchanger by the refrigeration circuit and calculating a setpoint condensing temperature for the refrigerant by adding the temperature differential setpoint to the temperature of the coolant provided to the condenser. The method further includes operating a control valve of the cooling circuit to modulate a flow of the coolant through the heat exchanger to achieve the setpoint condensing temperature for the refrigerant.

In some embodiments, the method includes identifying a maximum temperature limit for the condensing temperature of the refrigerant and preventing the controller from further closing the control valve in response to the condensing temperature of the refrigerant exceeding the maximum temperature limit.

In some embodiments, the method includes identifying a minimum temperature limit for the condensing temperature of the refrigerant and preventing the controller from further opening the control valve in response to the condensing temperature of the refrigerant dropping below the minimum temperature limit.

In some embodiments, the method includes setting a temperature differential constraint defining a minimum allowable temperature differential between a coolant outlet temperature at an outlet of the heat exchanger and a coolant inlet temperature at an inlet of the heat exchanger.

In some embodiments, the method includes monitoring the coolant outlet temperature and the coolant inlet temperature and calculating an actual temperature differential between the coolant outlet temperature and the coolant inlet temperature. The method further includes operating the control valve to decrease the flow of the coolant through the heat exchanger in response to the actual temperature differential being less than the temperature differential constraint.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Overview

Referring generally to the FIGURES, a refrigeration system with condenser temperature differential setpoint control is shown, according to various embodiments. The refrigeration system may be used in conjunction with a temperature-controlled display device (e.g., a refrigerated merchandiser) or other refrigeration device used to store and/or display refrigerated or frozen objects in a commercial, institutional, or residential setting. The refrigeration system includes a refrigerant loop including a condenser, an expansion valve, an evaporator, and a compressor. In some embodiments, the refrigerant loop operates using a vapor-compression refrigeration cycle in which a refrigerant is circulated between the condenser and the evaporator to provide cooling for the temperature-controlled display device.

In some embodiments, the condenser is liquid-cooled. For example, the refrigeration system may include a cooling loop that circulates a liquid coolant (e.g., water) through the condenser to provide cooling for the refrigerant in the refrigerant loop. In some embodiments, a controller for the refrigeration system operates a fluid control valve located along the cooling loop to modulate the flow of the liquid coolant through the condenser. The controller can operate the fluid control valve to achieve a setpoint temperature differential between the temperature of the liquid coolant as it enters the condenser and the condensing temperature of the refrigerant (e.g., the temperature of the refrigerant as it passes through the condenser or at an outlet of the heat exchanger). In some embodiments, the controller operates the fluid control valve subject to a constraint defining a minimum temperature differential between the temperature of the liquid coolant at the inlet and outlet of the condenser.

Additional features and advantages of the refrigeration system are described in greater detail below.

Temperature-Controlled Device

Figure 1:
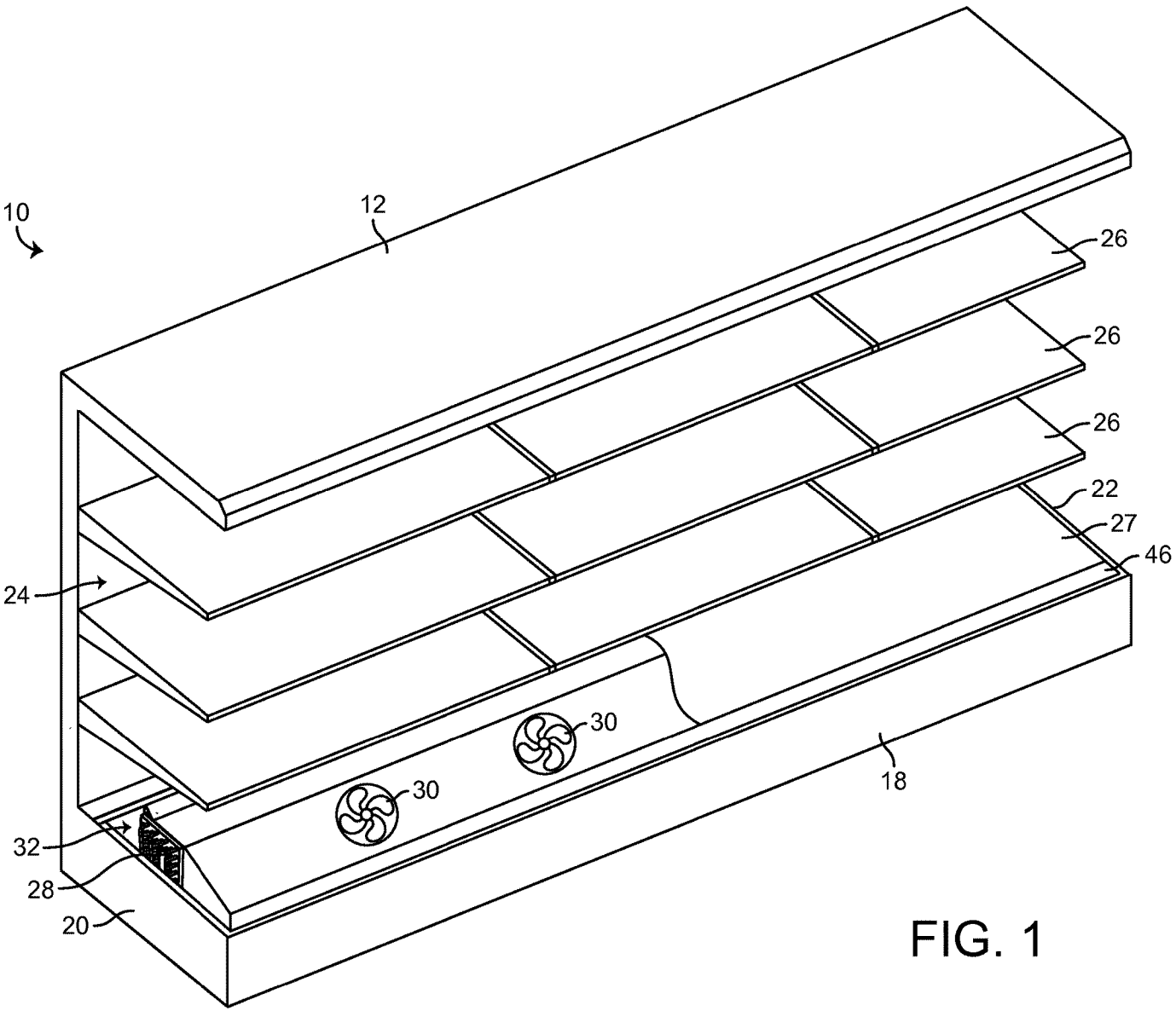
FIG. 1 is a perspective view of a temperature-controlled display device, according to some embodiments.
Figure 2:
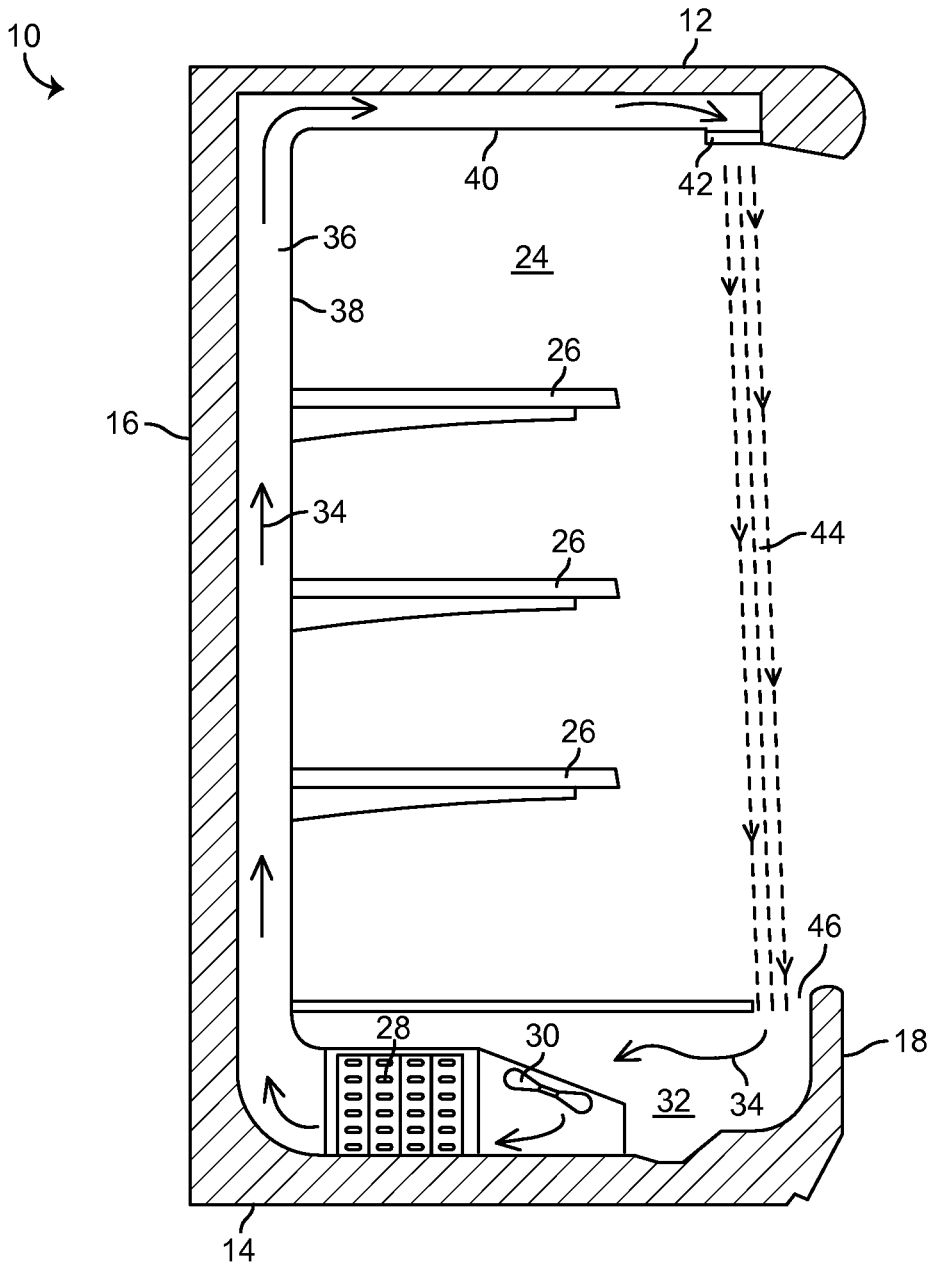
FIG. 2 is a cross-sectional elevation view of the temperature-controlled display device of FIG. 1, according to some embodiments.

Referring now to FIGS. 1-2, a temperature-controlled display device 10 is shown, according to an exemplary embodiment. Temperature controlled-display device 10 may be a refrigerator, a freezer, a refrigerated merchandiser, a refrigerated display case, or other device capable of use in a commercial, institutional, or residential setting for storing and/or displaying refrigerated or frozen objects. For example, temperature-controlled display device 10 may be a service-type refrigerated display case for displaying fresh food products (e.g., beef, pork, poultry, fish, etc.) in a supermarket or other commercial setting.

Temperature-controlled display device 10 is shown as a refrigerated display case having a top 12, bottom 14, back 16, front 18, and sides 20-22 that at least partially define a temperature-controlled space 24 within which refrigerated or frozen objects can be stored. In some embodiments, front 18 is at least partially open (as shown in FIGS. 1-2) to facilitate access to the refrigerated or frozen objects stored within temperature-controlled space 24. In other embodiments, front 18 may include one or more doors (e.g., hinged doors, sliding doors, etc.) that move between an open position and a closed position. The doors may be insulated glass doors including one or more transparent panels such that the objects within temperature-controlled space 24 can be viewed through the doors (i.e., from the exterior of display device 10) when the doors are closed. Similarly, sides 20-22 may be at least partially open (as shown in FIGS. 1-2) or closed to define side walls of temperature-controlled space 24.

Temperature-controlled display device 10 is shown to include a plurality of shelves 26-27 upon which refrigerated or frozen objects can be placed for storage and/or display. Shelves 26 may be located at various heights within temperature-controlled space 24. Shelf 27 defines a lower boundary of temperature-controlled space 24 and separates temperature-controlled space 24 from a lower space 32 within which various components of a refrigeration circuit for temperature-controlled display device 10 may be contained.

Space 32 is shown to include a cooling element 28 and a fan 30. Cooling element 28 may include a cooling coil, a heat exchanger, an evaporator, or other component configured to provide cooling for temperature-controlled space 24. Cooling element 28 may be part of a refrigeration loop (e.g., refrigerant loop 102 shown in FIG. 3) and may be configured to absorb heat from an airflow 34 passing over or through cooling element 28. Fan 30 may include one or more fans configured to cause airflow 34 through cooling element 28. In some embodiments, fan 30 causes airflow 34 from cooling element 28 to pass through a channel 36 along a rear surface 38 and/or upper surface 40 of temperature-controlled space 24. Rear surface 38 and/or upper surface 40 may include a plurality of outlets distributed along channel 36 (e.g., holes in rear surface 38 and/or upper surface 40 into channel 36) through which airflow 34 can pass from channel 36 into temperature-controlled space 24.

Referring particularly to FIG. 2, channel 36 is shown to include an outlet 42 configured to direct airflow 34 downward from a front end of channel 36. The downward airflow from outlet 42 may form an air curtain 44 between outlet 42 and inlet 46. Air curtain 44 may help retain chilled air within temperature-controlled space 24 and may prevent the ingression of ambient air (e.g., warmer air from outside temperature-controlled display device 10) into temperature-controlled space 24. Air curtain 44 and airflow 34 may be created by operating fan 30. Fan 30 may be configured to draw airflow 34 through inlet 46 and may cause airflow 34 to pass through cooling element 28. Airflow 34 is chilled by cooling element 28 and is forced into temperature-controlled space 24 by operation of fan 30.

Refrigeration System

Figure 3:
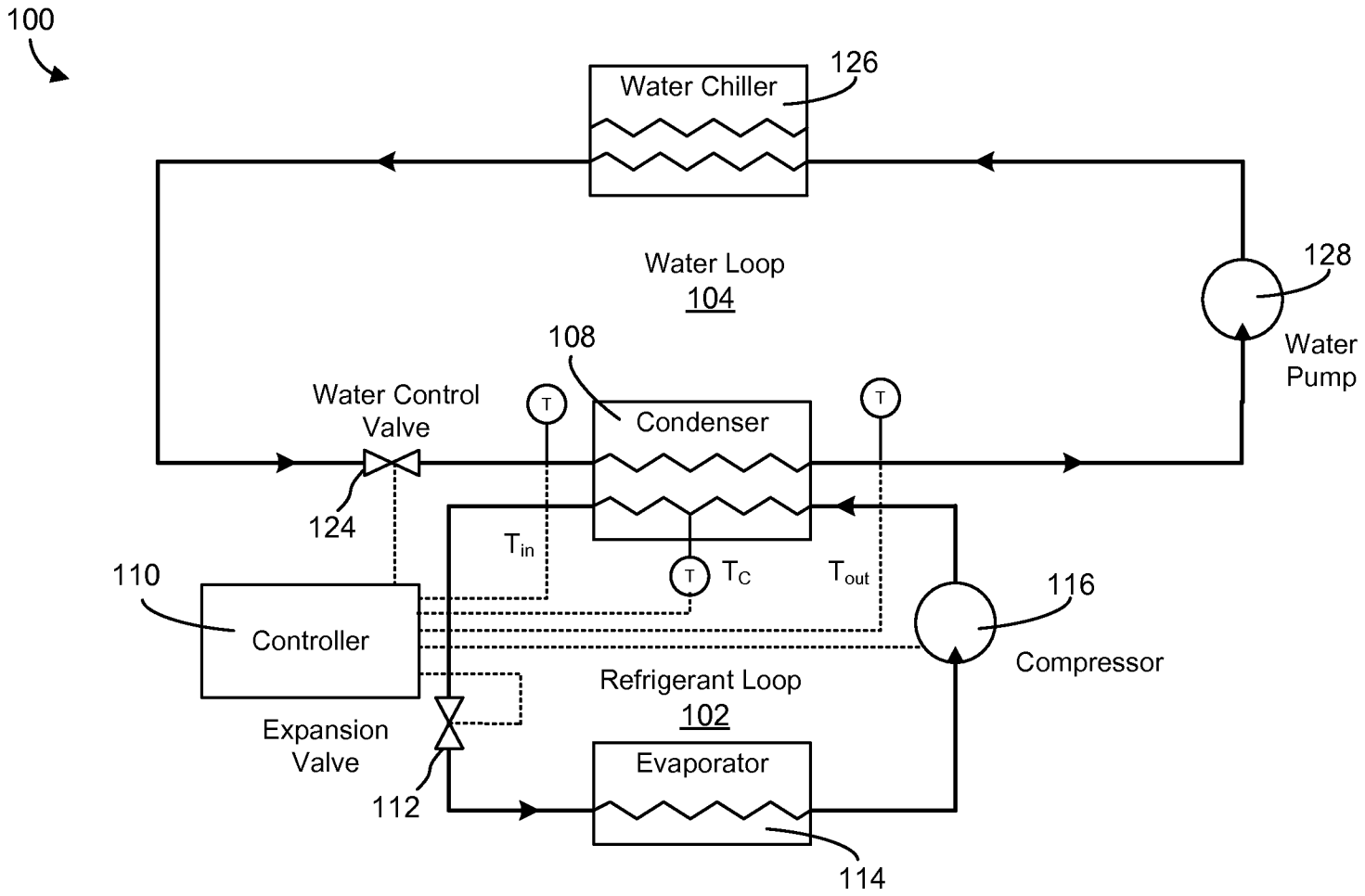
FIG. 3 is a block diagram of a liquid-cooled refrigeration system which may be used in conjunction with the temperature-controlled display device of FIG. 1, according to some embodiments.

Referring now to FIG. 3, a liquid-cooled refrigeration system 100 is shown, according to an exemplary embodiment. In some embodiments, liquid-cooled refrigeration system 100 may be used in conjunction with temperature-controlled display device 10. Refrigeration system 100 is shown to include a refrigerant loop 102 and a water loop 104. Refrigerant loop 102 and water loop 104 are shown as separate loops that are not in fluid communication with each other. However, condenser 108 thermally couples refrigerant loop 102 and water loop 104 to allow for heat transfer therebetween.

Refrigerant loop 102 is shown to include a condenser 108, a controller 110, an expansion valve 112, an evaporator 114, and a compressor 116. Condenser 108 may be a heat exchanger or other similar device for removing heat from a refrigerant that circulates between evaporator 114 and condenser 108. Condenser 108 may receive vapor refrigerant from compressor 116 and may partially or fully condense the vapor refrigerant by removing heat from the refrigerant. The condensation process may result in a liquid refrigerant or a liquid-vapor mixture. In other embodiments, condenser 108 cools the refrigerant vapor (e.g., by removing superheat) without condensing the refrigerant vapor. In some embodiments, the cooling/condensation process is an isobaric process. Condenser 108 provides the cooled and/or condensed refrigerant to expansion valve 112.

Expansion valve 112 may be an electronic expansion valve or another similar expansion device. Expansion valve 112 may be controlled by controller 110 (e.g., using an automatic control scheme), manually by a user, or may be set to a predetermined position. Expansion valve 112 may cause the refrigerant to undergo a rapid drop in pressure, thereby expanding the refrigerant to a lower pressure, lower temperature state. The expanded refrigerant is then provided to evaporator 114.

Evaporator 114 is shown receiving the cooled and expanded refrigerant from expansion valve 112. In some embodiments, evaporator 114 is associated with display cases/devices (e.g., if refrigeration system 100 is implemented in a supermarket setting). Evaporator 114 may be configured to facilitate the transfer of heat from the display cases/devices into the refrigerant. The added heat may cause the refrigerant to evaporate partially or completely. In some embodiments, the evaporation process may be an isobaric process. Evaporator 114 provides the refrigerant to compressor 116, which operates to compress the refrigerant. Compressor 116 may be controlled by controller 110, or by any suitable controller and control scheme. Compressor 116 is shown discharging the refrigerant upstream of condenser 108, wherein the refrigerant may re-cycle through refrigerant loop 102.

Still referring to FIG. 3, water loop 104 is shown to include condenser 108, water control valve 124, water chiller 126, and water pump 128. As described above, condenser 108 may be a heat exchanger or other similar device for removing heat from the refrigerant in refrigerant loop 102. This removal may be accomplished as heat from the refrigerant in refrigerant loop 102 is absorbed by water circulating through water loop 104. Although water loop 104 is described as circulating water, it is contemplated that any of a variety of coolants or working fluids can be used in water loop 104. Accordingly, it should be understood that all references to water in the present disclosure can be replaced with another coolant or working fluid that circulates through water loop 104 to provide cooling for condenser 108.

In some embodiments, upon being discharged from condenser 108, the water will flow through water pump 128. Water pump 128 circulates water through water loop 104 between condenser 108 and water chiller 126. In some embodiments, the discharge pressure of water pump 128 may be monitored by controller 110, and the operational parameters of water pump 128 may be altered via control signals from controller 110 in order to maintain required fluid pressure in water loop 104. In other embodiments, controller 110 may operate water pump 128 based on a flow rate (e.g., mass flow, volume flow, etc.) of water through water control valve 124.

Once the water has exited water pump 128, it may flow through water chiller 126. In various embodiments, water chiller 126 may be a heat exchanger or other device configured to provide cooling for the water circulating through water loop 104. In some embodiments, heat removal from the water in water loop 104 may be provided by a secondary refrigerant circulated water chiller 126.

After the water in water loop 104 has been chilled by water chiller 126, it may flow through water control valve 124. In some embodiments, controller 110 operates water control valve 124 to control the flow of water into condenser 108. Water control valve 124 may be an electronic modulating valve that may be operated in a fully closed position, a fully open position, or any position therebetween in response to a control signal from controller 110. In some instances, the position of water control valve 124 may be expressed as a percentage. For example, 100% may represent a fully open valve, 0% may represent a fully closed valve, and 50% may represent a half-open valve.

Controller 110 may perform a variety of functions in refrigeration system 100, including operating expansion valve 112, compressor 116, water control valve 124, and/or water pump 128. Controller 110 may monitor certain parameters of refrigerant loop 102 and refrigeration system 100 (e.g., refrigerant temperature in evaporator, refrigerant condensing temperature $T_c$, refrigerant pressure downstream of compressor 116, water inlet temperature $T_{in}$, water outlet temperature $T_{out}$, etc.) and may operate various components of refrigeration system 100 based on the measured values. For example, in some embodiments, controller 110 may deactivate compressor 116 and/or cause expansion valve 112 to close when cooling is not required (i.e., when refrigerant temperature in evaporator 114 reaches a specified value, etc.). In some embodiments, controller 110 may operate compressor 116 based on a flow rate (e.g., mass flow, volume flow, etc.) of refrigerant through expansion valve 112. In some embodiments, controller operates water control valve 124 to achieve a condenser temperature differential setpoint (described in greater detail below).

Controller 110 may include feedback control functionality for adaptively operating the various components of refrigeration system 100. For example, controller 110 may receive a setpoint (e.g., a temperature setpoint, a pressure setpoint, a flow rate setpoint, a power usage setpoint, etc.) and operate one or more components of refrigeration system 100 to achieve the setpoint. The setpoint may be specified by a user (e.g., via a user input device, a graphical user interface, a local interface, a remote interface, etc.) or automatically determined by controller 110 based on a history of data measurements.

Controller 110 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some embodiments, controller 110 is a local controller for refrigerant loop 102. In other embodiments, controller 110 is a supervisory controller for a plurality of controlled subsystems (e.g., refrigeration system 100, an AC system, a lighting system, a security system, etc.). For example, controller 110 may be a controller for a comprehensive building management system incorporating refrigeration system 100. Controller 110 may be implemented locally, remotely, or as part of a cloud-hosted suite of building management applications.

In some embodiments, controller 110 receives input from sensory devices via a communications interface. The communications interface may include wired or wireless interfaces (e.g., jacks, antennas, transmitters, receivers, transceivers, wire terminals, etc.) for conducting data communications with various systems, devices, or networks. For example, the communications interface may include an Ethernet card and port for sending and receiving data via an Ethernet-based communications network. In another example, the communications interface may include a WiFi transceiver for communicating via a wireless communications network. The communications interface may be configured to communicate via local area networks or wide area networks (e.g., the Internet, a building WAN, etc.) and may use a variety of communications protocols (e.g., TCP/IP, point-to-point, etc.). In some embodiments, controller 110 uses the communications interface to send control signals to various operable components of refrigeration system 100.

In some embodiments, controller 110 includes a processing circuit having a processor and memory. The processor may be a general purpose or specific purpose processor, an application specific integrated circuit (ASIC), one or more field programmable gate arrays (FPGAs), a group of processing components, or other suitable processing components. The processor may be configured to execute computer code or instructions stored in memory or received from other computer readable media (e.g., CDROM, network storage, a remote server, etc.). Memory may include one or more devices (e.g., memory units, memory devices, storage devices, etc.) for storing data and/or computer code for completing and/or facilitating the various processes described in the present disclosure. Memory may include random access memory (RAM), read-only memory (ROM), hard drive storage, temporary storage, non-volatile memory, flash memory, optical memory, or any other suitable memory for storing software objects and/or computer instructions. Memory may include database components, object code components, script components, or any other type of information structure for supporting the various activities and information structures described in the present disclosure. Memory may be communicably connected to the processor via the processing circuit and may include computer code for executing one or more processes described herein.

Water Control Valve Operation

Controller 110 can operate water control valve 124 to increase or decrease the flow of water through condenser 108. Operating water control valve 124 may include causing water control valve 124 to open (completely or partially) to increase the flow of water through condenser 108 and/or causing water control valve 124 to close (completely or partially) to decrease the flow of water through condenser 108. Increasing the flow of water through condenser 108 can change the rate of heat transfer within condenser 108, thereby decreasing the condensing temperature $T_c$ and reducing the difference $\Delta T$ between the condensing temperature $T_c$ and the condenser water inlet temperature $T_{in}$. Conversely, decreasing the flow of water through condenser 108 can decrease the rate of heat transfer within condenser 108, thereby increasing the condensing temperature $T_c$ and increasing the difference $\Delta T$ between the condensing temperature $T_c$ and the condenser water inlet temperature $T_{in}$.

In some embodiments, controller 110 operates water control valve 124 to achieve a setpoint temperature differential $\Delta T_{sp}$ between the water inlet temperature $T_{in}$ (i.e., the temperature of the water entering condenser 108) and the refrigerant condensing temperature $T_c$ (i.e., the temperature of the refrigerant passing through condenser 108). In some embodiments, the water inlet temperature $T_{in}$ is measured using a temperature sensor located at the inlet of condenser 108. Condensing temperature $T_c$ can also be measured by a temperature sensor configured to measure the refrigerant temperature within condenser 108 or downstream of condenser 108. In other embodiments, the condensing pressure of the refrigerant is measured by a pressure sensor and converted by controller 110 to a temperature value. The temperature differential setpoint $\Delta T_{sp}$ may be manually input to controller 110 by a user, or it may be determined automatically by controller 110 through the use of an algorithm.

Controller 110 can use measured values of the water inlet temperature $T_{in}$ and the refrigerant condensing temperature $T_c$ to calculate an actual temperature difference $\Delta T$ therebetween. For example, controller 110 can subtract the water inlet temperature $T_{in}$ from the refrigerant condensing temperature $T_c$ to calculate the actual temperature difference $\Delta T$ (i.e., $\Delta T=T_c-T_{in}$). Controller 110 can operate water control valve 124 to achieve the temperature differential setpoint $\Delta T_{sp}$ by variably opening or closing water control valve 124 until the actual temperature differential $\Delta T$ reaches the temperature differential setpoint $\Delta T_{sp}$.

In some embodiments, controller 110 operates water control valve 124 to achieve a variable setpoint condensing temperature $T_{c,sp}$. In some embodiments, controller 110 calculates the condensing temperature setpoint $T_{c,sp}$ based on the measured water inlet temperature $T_{in}$ and the temperature differential setpoint $\Delta T_{sp}$. For example, controller 110 can obtain the water inlet temperature $T_{in}$ from a temperature sensor located along water loop 104. In various embodiments, the temperature sensor can be located at the inlet of condenser 108 (as shown in FIG. 3) or at another location between water chiller 126 and condenser 108 (e.g., upstream of water control valve 124 or downstream of water control valve 124). Controller 110 can add the temperature differential setpoint $\Delta T_{sp}$ to the water inlet temperature $T_{in}$ to calculate the condensing temperature $T_{c,sp}$ setpoint (i.e., $T_{c,sp}=T_{in}+\Delta T_{sp}$). Controller 110 can operate water valve 124 to achieve the variable condensing temperature setpoint $T_{c,sp}$.

In previous water-cooled refrigeration systems, controller 110 would store a fixed condensing temperature setpoint $T_{c,sp}$ for the refrigerant in refrigerant loop 102 and attempt to operate water control valve 124 until the condensing temperature $T_c$ has reached the setpoint value $T_{c,sp}$. This control technique may greatly limit the efficiency of the refrigeration system. For example, if the ambient temperature or other factors cause the water inlet temperature $T_{in}$ to be higher than the condensing temperature setpoint $T_{c,p}$, controller 110 might fully open water control valve 124 in an attempt to reach a physically impossible condensing setpoint temperature $T_{c,sp}$, needlessly wasting energy and overstressing the components of the refrigeration system. Advantageously, operating control valve 124 to achieve the temperature differential setpoint $\Delta T_{sp}$ avoids this scenario because the condensing temperature setpoint $T_{c,sp}$ is guaranteed to be higher than the water inlet temperature $T_{in}$ (i.e., $T_{c,sp}=T_{in}+\Delta T_{sp}$).

In some embodiments, controller 110 operates water control valve 124 subject to a constraint defining a minimum temperature differential $\Delta T_{min}$ between the water inlet temperature $T_{in}$ (i.e., the temperature of the water entering condenser 108) and the water outlet temperature $T_{out}$ (i.e., the temperature of the water exiting condenser 108). Controller 110 can calculate an actual water temperature differential $\Delta T_w$ by subtracting the water inlet temperature $T_{in}$ from the water outlet temperature $T_{out}$ (i.e., $\Delta T_w=T_{out}-T_{in}$). Controller 110 can operate water valve 124 to ensure that the actual water temperature differential $\Delta T_w$ does not drop below the minimum temperature differential $\Delta T_{min}$. In various embodiments, the minimum temperature differential $\Delta T_{min}$ may be set in controller 110, either by a user or by an algorithm, at a relatively small value (e.g., 2-3 degrees).

The minimum temperature differential $\Delta T_{min}$ may serve to increase the efficiency of the refrigeration system. For example, when controller 110 detects that the actual water temperature differential $\Delta T_w$ is less than the minimum temperature differential $\Delta T_{min}$, controller 110 may send a signal to close control valve 124 (fully or partially) and reduce the flow of water through condenser 108. Reducing the flow of water may increase the water outlet temperature $T_{out}$ (e.g., by allowing the water more time to absorb heat from the refrigerant in condenser 108), thereby increasing the actual water temperature differential $\Delta T_w$. Closing control valve 124 may preserve system resources in a scenario where the condensing temperature $T_c$ is very close to the water inlet temperature $T_{in}$, and thus little excess heat is absorbed from the refrigerant in condenser 108, regardless of the water flow rate. This may lead to an increase in overall system efficiency.

Figure 4:
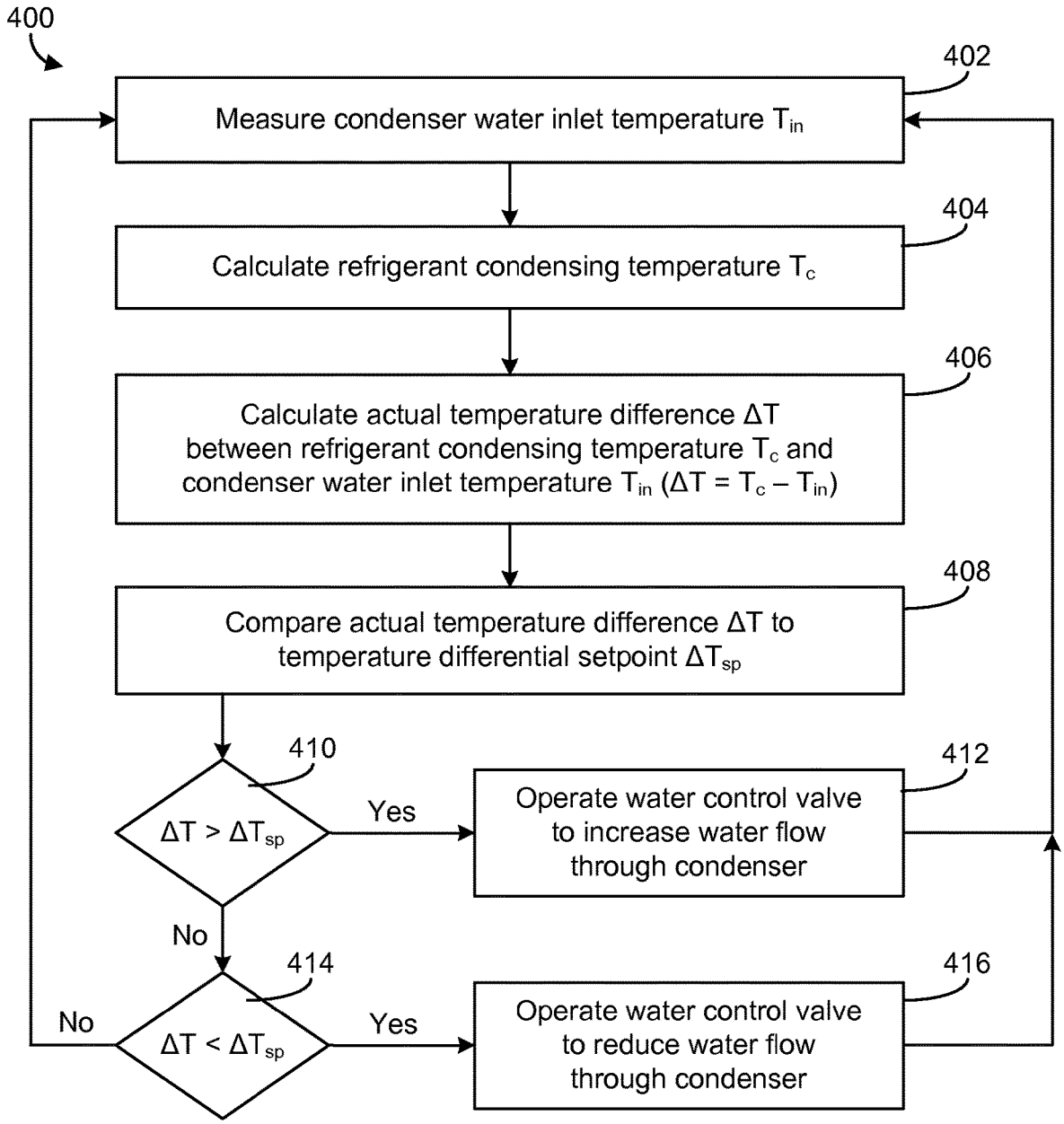
FIG. 4 is a flowchart of a process for operating a water control valve to achieve a temperature differential setpoint, according to some embodiments.

Referring now to FIG. 4, a flowchart of a process 400 for operating a water control valve to achieve a temperature differential setpoint $T_{sp}$ is shown, according to an exemplary embodiment. In some embodiments, process 400 is performed by controller 110 to operate water control valve 124. Process 400 is shown to include measuring the condenser water inlet temperature $T_{in}$ (step 402) and calculating the refrigerant condensing temperature $T_c$ (step 404). In some embodiments, the water inlet temperature $T_{in}$ is measured using a temperature sensor located at the inlet of condenser 108. Condensing temperature $T_c$ can also be measured by a temperature sensor configured to measure the refrigerant temperature within condenser 108 or downstream of condenser 108. In other embodiments, the condensing pressure of the refrigerant is measured by a pressure sensor and converted by controller 110 to a temperature value. Controller 110 can calculate an actual temperature difference $\Delta T$ between the refrigerant condensing temperature $T_c$ and the condenser water inlet temperature $T_{in}$ (step 406) by subtracting the water inlet temperature $T_{in}$ from the refrigerant condensing temperature $T_c$ (i.e., $\Delta T=T_c-T_{in}$).

Process 400 is shown to include comparing the actual temperature difference $\Delta T$ to a temperature differential setpoint $\Delta T_{sp}$ (step 408). In some embodiments, controller 110 compares the actual temperature difference $\Delta T$ to the temperature differential setpoint $\Delta T_{sp}$ to determine whether to open or close water control valve 124. For example, controller 110 can determine whether the actual temperature difference $\Delta T$ is greater than the temperature differential setpoint $\Delta T_{sp}$ (step 410). If the actual temperature difference $\Delta T$ is greater than the temperature differential setpoint $\Delta T_{sp}$ (i.e., the result of step 410 is "yes"), controller 110 can operate water control valve 124 to increase water flow through condenser 108 (step 412). Increasing water flow through condenser 108 may function to change the rate of heat transfer to the cooling water, thereby reducing the condensing temperature $T_c$ and the actual temperature difference $\Delta T$. Process 400 may then return to step 402. However, if the actual temperature difference $\Delta T$ is not greater than the temperature differential setpoint $\Delta T_{sp}$ (i.e., the result of step 410 is "no"), process 400 may proceed to step 414.

Process 400 is shown to include determining whether the actual temperature difference $\Delta T$ is less than the temperature differential setpoint $\Delta T_{sp}$ (step 414). If the actual temperature difference $\Delta T$ is less than the temperature differential setpoint $\Delta T_{sp}$ (i.e., the result of step 414 is "yes"), controller 110 can operate water control valve 124 to decrease water flow through condenser 108 (step 416). Decreasing water flow through condenser 108 may function to increase the condensing temperature $T_c$ and the actual temperature difference $\Delta T$. Process 400 may then return to step 402. However, if the actual temperature difference $\Delta T$ is not less than the temperature differential setpoint $\Delta T_{sp}$ (i.e., the result of step 414 is "no"), process 400 may proceed directly to step 402 without adjusting the position of water control valve 124.

Figure 5:
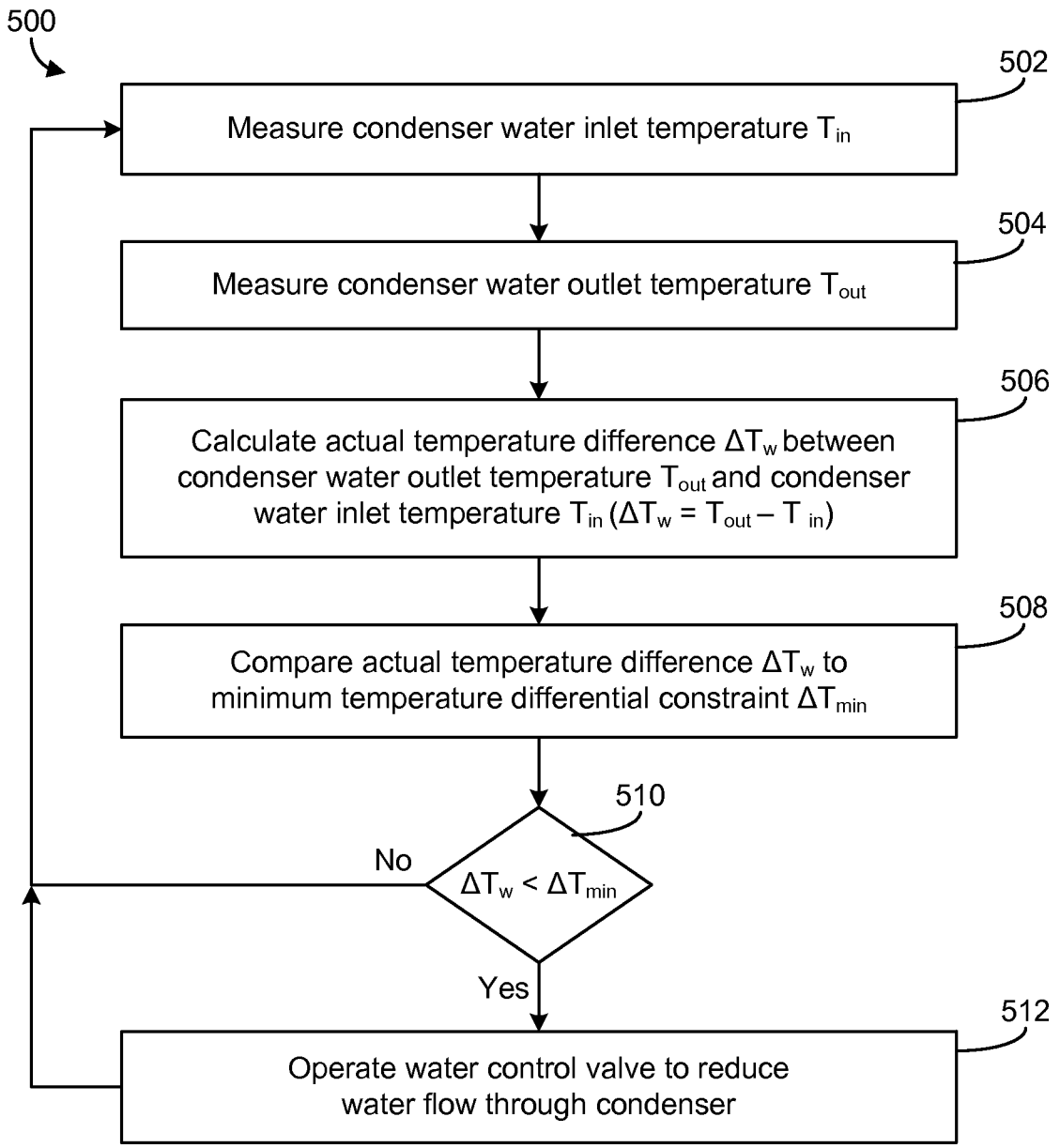
FIG. 5 is a flowchart of a process for operating a water control valve to satisfy a minimum condenser water temperature differential, according to some embodiments.

Referring now to FIG. 5, a flowchart of a process 500 for operating a water control valve to satisfy a minimum condenser water temperature differential is shown, according to an exemplary embodiment. In some embodiments, process 500 is performed by controller 110 to operate water control valve 124. Process 500 is shown to include measuring the condenser water inlet temperature $T_{in}$ (step 502) and measuring the condenser water outlet temperature $T_{out}$ (step 504). In some embodiments, the water inlet temperature $T_{in}$ is measured using a temperature sensor located at the inlet of condenser 108. Similarly, the water outlet temperature $T_{out}$ can be measured using a temperature sensor located at the outlet of condenser 108. Controller 110 can calculate an actual temperature difference $\Delta T_w$ between the condenser water outlet temperature $T_{out}$ and the condenser water inlet temperature $T_{in}$ (step 506) by subtracting the water inlet temperature $T_{in}$ from the water outlet temperature $T_{out}$ (i.e., $\Delta T_w = T_{out} - T_{in}$).

Process 500 is shown to include comparing the actual temperature difference $\Delta T_w$ to a minimum temperature differential constraint $\Delta T_{min}$ (step 508). In some embodiments, controller 110 compares the actual temperature difference $\Delta T_w$ to the minimum temperature differential $\Delta T_{min}$ to determine whether to open or close water control valve 124. For example, controller 110 can determine whether the actual temperature difference $\Delta T_w$ is less than the minimum temperature differential $\Delta T_{min}$(step 510). If the actual temperature difference $\Delta T_w$ is less than the minimum temperature differential $\Delta T_{min}$ (i.e., the result of step 510 is "yes"), controller 110 can operate water control valve 124 to reduce water flow through condenser 108 (step 512). Reducing water flow through condenser 108 may allow the cooling water more time to absorb heat from the refrigerant, thereby increasing the condenser water outlet temperature $T_{out}$ and the actual temperature difference $\Delta T_w$. Process 500 may then return to step 502. However, if the actual temperature difference $\Delta T_w$ is not less than the minimum temperature differential $\Delta T_{min}$ (i.e., the result of step 510 is "no"), process 500 may proceed directly to step 502 without reducing water flow through condenser 108.

Figure 6:
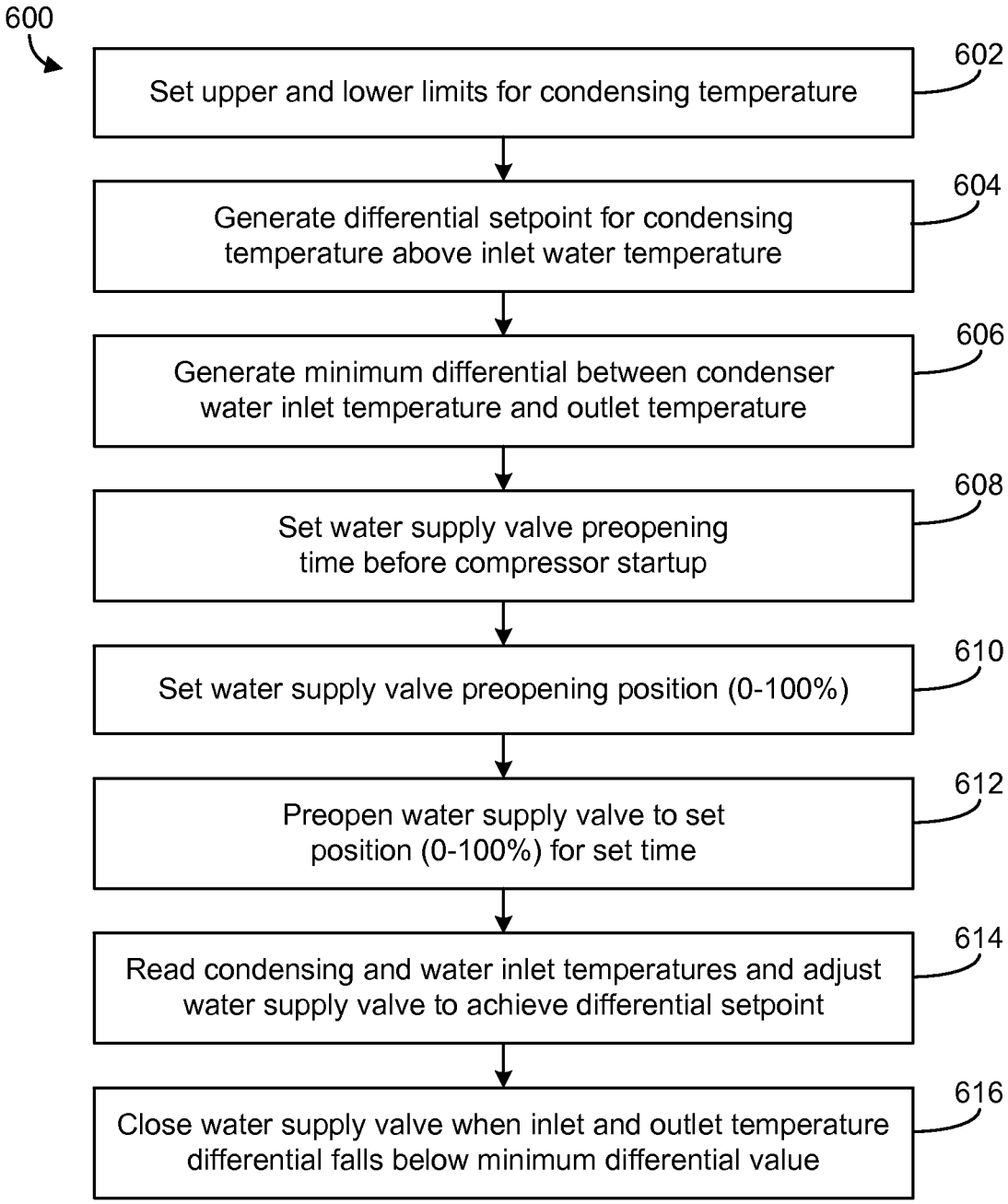
FIG. 6 is a flow diagram of a control process for the refrigeration system, according to some embodiments.

Referring now to FIG. 6, a process 600 for operating a refrigeration systems is shown, according to an exemplary embodiment. The steps of process 600 may be performed by a controller (e.g., controller 110), or the steps may comprise an algorithm performed by a controller. Alternatively, process 600 may be manually performed by a user during an installation or maintenance process of the refrigeration system.

Process 600 begins with step 602, in which limits are set for the condensing temperature $T_c$ of the refrigerant in condenser 108. In some instances, only a maximum temperature limit will be generated. In other instances, only a minimum temperature limit will be generated. In still further instances, both a maximum and a minimum temperature limit will be generated. Limits for the condensing temperature $T_c$ may be based on several factors, for example, the desired temperature of temperature-controlled display device 10, ambient weather conditions, etc.

Process 600 may continue to step 604, which includes generating a temperature differential setpoint $\Delta T_{sp}$. Temperature differential setpoint $\Delta T_{sp}$ may represent the ideal temperature differential to be achieved between the refrigerant condensing temperature $T_c$ and the condenser water inlet temperature $T_{in}$. The temperature differential setpoint $\Delta T_{sp}$ may vary based on the desired temperature for temperature-controlled display device 10, ambient weather conditions, or a variety of other factors. In various embodiments, the temperature differential setpoint $\Delta T_{sp}$ may be achieved by a user providing manual input to a controller, or automatically by a controller through the use of an algorithm.

In some embodiments, the temperature differential setpoint $\Delta T_{sp}$ is generated by performing an optimization process. The optimization process may determine an optimal value for the temperature differential setpoint $\Delta T_{sp}$ based on a variety of factors such as outside air temperature, outside air humidity, equipment power consumption, equipment efficiencies, a measured temperature of the water in water loop 104, desired temperatures for evaporators 114, etc. The optimization process can be performed by a controller (e.g., a supervisory controller) optimize a variable of interest (e.g., total system power consumption, total system operating cost based on utility prices, etc.) based on a set of measured values subject to temperature constraints for evaporators 114.

Advantageously, the optimization process allows the controller to determine whether energy is most efficiently spent by reducing the condenser water inlet temperature $T_{in}$ (e.g., by operating water chiller 126) or by operating water loop 104 and refrigerant loop 102 to achieve a tighter (i.e., lower) temperature differential setpoint $\Delta T_{sp}$. In some instances, the controller may determine that energy is most efficiently spent by operating water chiller 126 to reduce the condenser water inlet temperature $T_{in}$ of the water in water loop 104. Accordingly, the controller may generate a relatively high temperature differential setpoint $\Delta T_{sp}$ to reduce the power consumption of water loop 104 and refrigerant loop 102. In other instances, the controller may determine that energy is most efficiently spent by reducing the power consumption of water chiller 126 (which results in a higher condenser water inlet temperature $T_{in}$) and increasing the power consumption of water loop 104 and/or refrigerant loop 102. Accordingly, the controller may generate a relatively low temperature differential setpoint $\Delta T_{sp}$ to achieve the required amount of cooling given the higher inlet water temperature $T_{in}$.

Process 600 may then proceed to step 606, in which a constraint defining a minimum temperature differential $\Delta T_{min}$ is identified. The minimum temperature differential constraint $\Delta T_{min}$ may define a minimum allowable differential between the temperature of the water at the outlet of condenser 108 (i.e., $T_{out}$) and the temperature of the water at the inlet of condenser 108 (i.e., $T_{in}$). In some embodiments, the minimum temperature differential $\Delta T_{min}$ is small, for example 2-3 degrees. The minimum temperature differential may increase system efficiency in a scenario when the condensing temperature $T_c$ is very close to the water inlet temperature $T_{in}$ and little excess heat is be absorbed by the water passing through condenser 108. Like differential setpoint $\Delta T_{sp}$, the minimum temperature differential constraint $\Delta T_{min}$ may be generated through manual user input or automatic generation by an algorithm.

Following step 606, process 600 may proceed to a series of steps relating to a preopening period of water control valve 124. During the preopening period, water may begin flowing through water loop 104 while water pump 128 begins a startup procedure. This startup procedure may occur before the refrigerant in water loop 104 is circulating at a normal operating flow rate and pressure. The use of a preopening period may lead to increased system efficiency, as control valve 124 may require a substantial time period (e.g., more than 30 seconds) to travel from a fully closed to a fully open position. Opening control valve 124 and starting the flow while water pump 128 is completing its startup procedure reduces any idle time waiting for control valve 124 to open once water pump 128 is ready to begin normal operation.

In step 608, the controller may set a preopening time period. In various embodiments, the preopening time period may be based on the time required for water pump 128 to complete a startup procedure, the time required for control valve 124 to travel to an open or semi-open position, or it may be a period manually selected by a user or generated by a control algorithm. Step 610 includes setting a position for control valve 124 during the preopening period. As described above, the position for control valve 124 may be expressed as a percentage, for example, 0% for a fully closed position or 100% for a fully opened position. Similar to the preopening time period, the preopening valve position may be manually selected by a user or generated by a control algorithm. Finally, at step 612, process 600 reaches the start of the preopening period, and control valve 124 may be opened to the position set in step 610, for the period of time set in step 608.

After the period set for the preopening period has expired and the refrigeration system has begun normal operation, process 600 may proceed to step 614. In step 614, the controller may receive sensor input indicating inlet temperature $T_{in}$ and condensing temperature $T_c$. Based on these temperature values, the controller may operate control valve 124 to increase or decrease the flow rate through water loop 104 until condensing temperature $T_c$ reaches its setpoint value. The setpoint value for condensing temperature $T_c$ may be calculated by adding the value of the temperature differential setpoint $\Delta T_{sp}$ (generated in step 604) to the condenser water inlet temperature $T_{in}$ (i.e., $T_{c,sp}=T_{in}+\Delta T_{sp}$). Once the setpoint condensing temperature $T_{c,sp}$ has been reached, the controller may cease operating control valve 124 and cause the valve to hold its current position. In some embodiments, step 614 may also include the controller monitoring the condensing temperature $T_c$ to ensure it does not exceed any limits set in step 602. If a limit is reached, the controller may cease operating control valve 124 and cause the valve to hold its current position.

In step 616, the controller may close or decrease flow through water control valve 124 of water loop 104 whenever the controller has determined that the difference the between condenser water outlet temperature $T_{out}$ and the condenser inlet temperature $T_{in}$ meets or falls below the minimum differential temperature constraint $\Delta T_{min}$ generated in step 606. Step 616 may be performed at any time during process 600 and serves as a constraint on the operations performed in steps 602-614.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The background section is intended to provide a background or context to the invention recited in the claims. The description in the background section may include concepts that could be pursued, but are not necessarily ones that have been previously conceived or pursued. Therefore, unless otherwise indicated herein, what is described in the background section is not prior art to the description and claims and is not admitted to be prior art by inclusion in the background section.

What is claimed is:

1. A refrigeration system for a temperature-controlled storage device, comprising:

a refrigeration circuit configured to circulate a refrigerant, the refrigeration circuit comprising a compressor, a condenser, an expansion device, and an evaporator;

a cooling circuit separate from the refrigeration circuit and configured to circulate a coolant through the condenser to provide cooling for the refrigerant, the cooling circuit comprising a pump, a control valve, and a chiller in fluid communication with the condenser via the coolant; and a controller operatively coupled to the control valve, the controller configured to:

identify a temperature differential setpoint, wherein the temperature differential setpoint is a target value of a difference between an inlet temperature of the coolant provided to the condenser by the cooling circuit and a condensing temperature of the refrigerant in the condenser;

monitor the inlet temperature of the coolant provided to the condenser by the cooling circuit;

determine the condensing temperature of the refrigerant in the condenser;

calculate an actual temperature differential $\Delta T$ by calculating a difference between the inlet temperature of the coolant provided to the condenser and the condensing temperature of the refrigerant in the condenser; and provide a signal to the control valve to modulate a flow of the coolant through the condenser to drive the actual temperature differential $\Delta T$ to the temperature differential setpoint, wherein the refrigerant is carbon dioxide (CO2); and wherein the controller is configured to:

at least partially open the control valve to increase the flow of the coolant through the condenser when the actual temperature differential $\Delta T$ is higher than the temperature differential setpoint; and at least partially close the control valve to decrease the flow of the coolant through the condenser when the actual temperature differential $\Delta T$ is lower than the temperature differential setpoint.

2. The refrigeration system of claim 1, wherein the controller is configured to determine the condensing temperature of the refrigerant in the condenser using a sensor arranged within the condenser.

3. The refrigeration system of claim 2, wherein the controller is configured to determine the condensing temperature of the refrigerant in the condenser by:

monitoring a condensing pressure of the refrigerant in the condenser using the sensor; and calculating the condensing temperature based on the condensing pressure.

4. The refrigeration system of claim 1, wherein the coolant is water or a mixture of water and glycol.

5. The refrigeration system of claim 1, wherein the controller is configured to:

identify a minimum temperature differential constraint defining a minimum acceptable temperature differential between a coolant outlet temperature at an outlet of the condenser and the inlet temperature of the coolant provided to the condenser;

monitor the coolant outlet temperature at the outlet of the condenser and the inlet temperature of the coolant provided to the condenser;

calculate another actual temperature differential ΔTw between the coolant outlet temperature and the inlet temperature of the coolant provided to the condenser; and operate the control valve to decrease the flow of the coolant through the condenser in response to the other actual temperature differential ΔTw being less than the minimum temperature differential constraint.

6. The refrigeration system of claim 1, wherein the controller is configured to:

identify a minimum temperature differential constraint defining a minimum acceptable temperature differential between a temperature of the coolant at an outlet of the condenser and the inlet temperature of the coolant provided to the condenser;

monitor another actual temperature differential ΔTw between the temperature of the coolant at the outlet of the condenser and the inlet temperature of the coolant provided to the condenser; and operate the control valve to decrease the flow of the coolant through the condenser in response to the other actual temperature differential ΔTw being less than the minimum temperature differential constraint.

7. The refrigeration system of claim 1, wherein the controller is configured to operate at least one of the compressor and the expansion device to modulate a flow rate of the refrigerant to maintain a desired temperature of the temperature-controlled storage device.

8. The refrigeration system of claim 1, wherein the controller is configured to:

identify a preopening time period for the control valve during an initialization period of the refrigeration system;

identify a preopening position for the control valve during the initialization period; and operate the control valve to achieve the preopening position for a duration of the preopening time period;

wherein the preopening time period corresponds with a time period for the pump to complete a startup procedure.

9. A cooling circuit for a temperature-controlled storage device, comprising:

a pump configured to circulate a coolant through the cooling circuit;

a heat exchanger configured to transfer heat from a refrigerant flowing through the heat exchanger to the coolant flowing through the heat exchanger;

a fluid control valve operable to modulate a flow rate of the coolant through the heat exchanger; and a controller configured to:

identify a temperature differential setpoint value, wherein the temperature differential setpoint value is a target value of a temperature differential between a condensing temperature of the refrigerant in the heat exchanger and an inlet temperature of the coolant as it enters the heat exchanger;

monitor the inlet temperature of the coolant provided to the heat exchanger by the cooling circuit;

determine the condensing temperature of the refrigerant in the heat exchanger; and operate the fluid control valve to modulate the flow rate of the coolant through the heat exchanger to drive an actual temperature differential ΔT between the condensing temperature of the refrigerant in the heat exchanger and the temperature of the coolant as it enters the heat exchanger to the temperature differential setpoint value, wherein the fluid control valve is operated based on a value of the actual temperature differential ΔT relative to the target value of the temperature differential, and wherein operating the fluid control valve to modulate the flow rate of the coolant through the heat exchanger to drive the actual temperature differential ΔT between the condensing temperature of the refrigerant in the heat exchanger and the temperature of the coolant as it enters the heat exchanger to the temperature differential setpoint value comprises:

at least partially opening the control valve to increase the flow of the coolant through the condenser when the actual temperature differential ΔT is higher than the temperature differential setpoint value; and at least partially closing the control valve to decrease the flow of the coolant through the condenser when the actual temperature differential ΔT is lower than the temperature differential setpoint value.

10. The cooling circuit of claim 9, further comprising a chiller configured to provide cooling for the coolant.

11. The cooling circuit of claim 9, wherein the coolant is water or a mixture of water and glycol.

12. The cooling circuit of claim 9, wherein the refrigerant is carbon dioxide (CO2).

13. A method for controlling a refrigeration system that includes a refrigeration circuit, a cooling circuit, and a heat exchanger coupled to the refrigeration circuit and the cooling circuit, the method comprising:

identifying, by a controller for the refrigeration system, a temperature differential setpoint, wherein the temperature differential setpoint is a target value of a difference between an inlet temperature of a coolant provided to the heat exchanger by the cooling circuit and a condensing temperature of a refrigerant provided to the heat exchanger by the refrigeration circuit;

monitoring, by the controller, the inlet temperature of the coolant provided to the heat exchanger by the cooling circuit;

determining, by the controller, the condensing temperature of the refrigerant provided to the heat exchanger by the refrigeration circuit; and operating, by the controller, a control valve of the cooling circuit to modulate a flow of the coolant through the heat exchanger to drive an actual temperature differential ΔT between the condensing temperature of the refrigerant provided to the heat exchanger and the inlet temperature of the coolant provided to the heat exchanger to the temperature differential setpoint, wherein operating the control valve of the cooling circuit to modulate a flow of the coolant through the heat exchanger to drive the actual temperature differential ΔT between the condensing temperature of the refrigerant provided to the heat exchanger and the inlet temperature of the coolant provided to the heat exchanger to the temperature differential setpoint comprises:

at least partially opening the control valve to increase the flow of the coolant through the condenser when the actual temperature differential ΔT is higher than the temperature differential setpoint; and at least partially closing the control valve to decrease the flow of the coolant through the condenser when the actual temperature differential ΔT is lower than the temperature differential setpoint.

14. The method of claim 13, further comprising:

identifying a maximum temperature limit for the condensing temperature of the refrigerant; and preventing the controller from further closing the control valve in response to the condensing temperature of the refrigerant exceeding the maximum temperature limit.

15. The method of claim 13, further comprising:

identifying a minimum temperature limit for the condensing temperature of the refrigerant; and preventing the controller from further opening the control valve in response to the condensing temperature of the refrigerant dropping below the minimum temperature limit.

16. The method of claim 13, further comprising setting, by the controller, a temperature differential constraint defining a minimum allowable temperature differential between a coolant outlet temperature at an outlet of the heat exchanger and the inlet temperature of the coolant provided to the heat exchanger.

17. The method of claim 16, further comprising:

monitoring the coolant outlet temperature and the inlet temperature of the coolant provided to the heat exchanger;

calculating an actual temperature differential ΔTw between the coolant outlet temperature and the inlet temperature of the coolant provided to the heat exchanger; and operating the control valve to decrease the flow of the coolant through the heat exchanger in response to the actual temperature differential ΔTw being less than the temperature differential constraint.

* * * * *